United States Patent [19]

Putnam

[11] 4,360,937

[45] Nov. 30, 1982

[54] METHOD AND APPARATUS FOR WET PROCESSING TEXTILE MATERIAL

[75] Inventor: Howard G. Putnam, Gastonia, N.C.

[73] Assignee: Gaston County Dyeing Machine Company, Stanley, N.C.

[21] Appl. No.: 234,355

[22] Filed: Feb. 13, 1981

[51] Int. Cl.[3] ..... D06B 3/26; D06B 3/28

[52] U.S. Cl. ..... 8/152; 68/62; 68/178

[58] Field of Search ..... 8/152; 68/177, 178, 68/181 R, 205 R, 62

[56] References Cited

U.S. PATENT DOCUMENTS

| | | | |
|---|---|---|---|
| 3,686,905 | 8/1972 | Stanway | 68/177 X |
| 3,696,645 | 10/1972 | Henningsen et al. | 68/177 |
| 3,718,012 | 2/1973 | Vinas | 68/177 X |
| 4,023,385 | 5/1977 | Hurd | 68/178 X |
| 4,318,286 | 3/1982 | Sturkey | 68/178 |

FOREIGN PATENT DOCUMENTS

| | | | |
|---|---|---|---|
| 2140788 | 2/1973 | Fed. Rep. of Germany | 68/178 |

*Primary Examiner*—Philip R. Coe

*Attorney, Agent, or Firm*—Richards, Shefte & Pinckney

[57] ABSTRACT

For use in textile processing, equipment such as jet dyeing machines, a fixed cloth tube for transporting cloth from the jet to the cloth storage compartment, such cloth tube having an exit end portion which is substantially greater in cross-sectional area than the portion extending from the jet, whereby the cloth leaving the cloth tube is permitted to assume a more open condition and whereby the velocity of the liquid flowing with the cloth is reduced as it leaves the cloth tube. A pair of cloth directing liquid jets are disposed oppositely in the exit end of the cloth tube, and a control system is provided for alternately admitting fluid to such cloth directing jets at predetermined time intervals to impose a sinuous path of movement on the cloth as it leaves the cloth tube and thereby provide an orderly and even distribution of the cloth within the cloth storage compartment.

15 Claims, 4 Drawing Figures

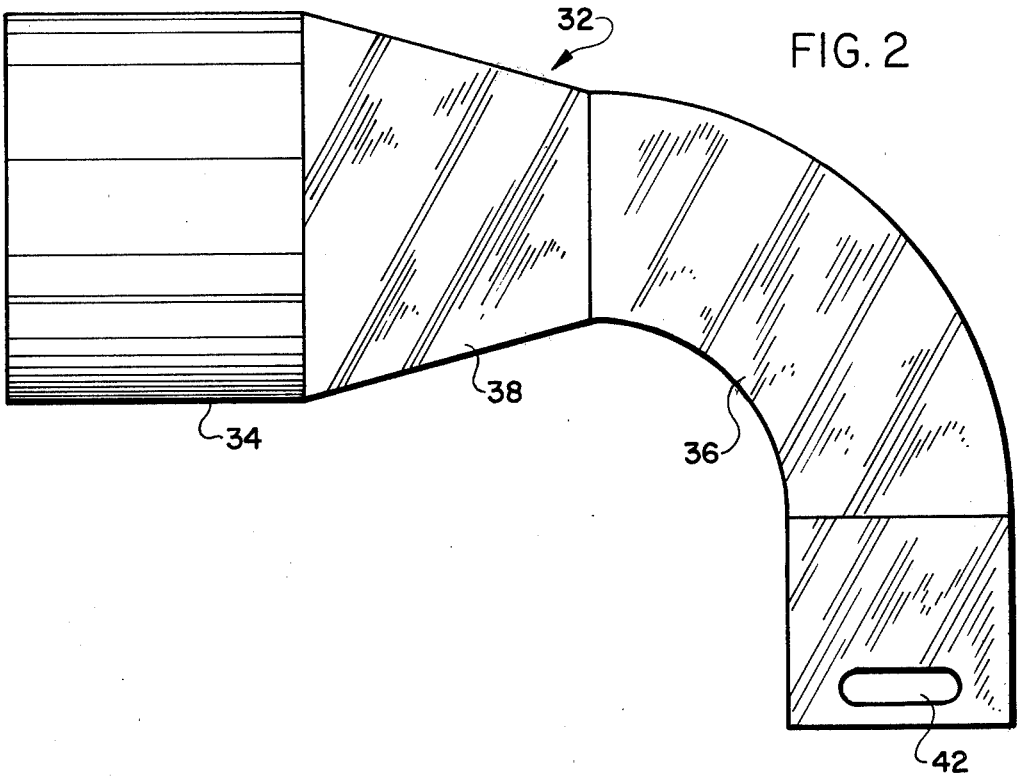
FIG. 2
FIG. 3
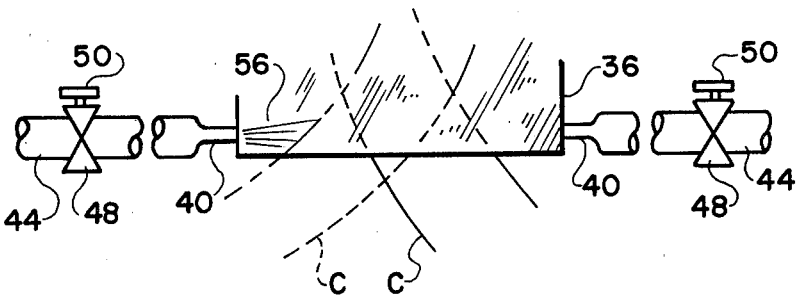
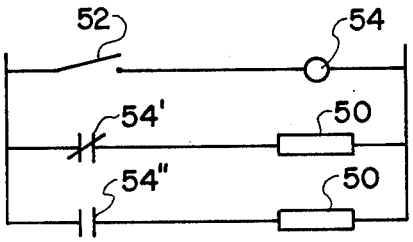
FIG. 4

METHOD AND APPARATUS FOR WET PROCESSING TEXTILE MATERIAL

BACKGROUND OF THE INVENTION

The present invention relates to a method and apparatus for wet processing textile material in rope form, and particularly to the handling of the textile material in a manner which effectively "opens" the textile material just prior to its being introduced in the bath of processing liquid and which provides a positive and effective means for uniformly piling or plaiting the textile material in the storage compartment that transiently retains the cloth as it proceeds through such bath.

In typical wet processing equipment such as jet machines, a bath of processing liquid, such as dye liquor, is provided, and a jet nozzle is utilized to continuously move the endless rope of textile material through the bath where the rope is transiently stored in a rope storage compartment extending generally through the bath. Frequently, a cloth tube is provided above the bath for receiving the cloth as it is discharged from the jet nozzle and for transporting the cloth and the liquid discharged from the jet to a location above the inlet end of the rope storage compartment where the cloth is directed into the chamber for transient storage as noted above. As the cloth leaves the cloth tube and is delivered into the storage compartment, the cloth entering the storage compartment falls onto the accumulated cloth therein and generally tends to assume a pyramidal form that alternately builds and recedes as the cloth falls to one side or another, thereby causing the cloth to ultimately be arranged in storage compartment in generally plaited condition as the cloth tends to fill the storage compartment. However, because of the generally random and unpredictable nature of folds which occur in the cloth, the plaited accumulation thereof is haphazard and non-uniform, and this results in an uneven distribution of the cloth within the storage compartment as well as a tendency to promote undesirable tangling of the cloth as it is moved through the storage compartment. Under these conditions, the available volume of the storage compartment is not utilized to maximum advantage because of the non-uniform piling of the cloth therein, and an uneven weight distribution is imposed on the cloth within the storage chamber which will have an adverse effect on a wide variety of fabrics, particularly textile woven fabrics made from modified cross-section yarns which are susceptible to excessive and undesirable crush marks when exposed to such uneven weight distribution.

In an effort to alleviate the disadvantages associated with non-uniform piling of the fabric in the storage chamber, several commercial jet machines have recently incorporated relatively complex mechanical arrangements for positively guiding the fabric in an oscillating path as it leaves the cloth tube and is directed into the storage chamber. Such mechanical arrangements have, in one case, included a freely suspended mouth at the discharge end of the cloth tube which is mechanically oscillated or swivelled to guide the cloth in a uniform path as it is fed into the storage compartment. In another case, the cloth tube itself is mechanically oscillated to guide the cloth as it leaves the discharge end of the cloth tube.

While the aforesaid mechanical arrangements have improved the uniformity of the piling of the cloth, they have the disadvantages of being somewhat complicated in construction and operation because of the moving parts which must be associated with them, and, perhaps more importantly, such moving parts must be located to a large extent within the confines of the treating vessel so that any malfunction, repair or maintenance of these parts will normally necessitate taking the equipment out of service at least temporarily, and the time and labor required to effectuate repairs and maintenance are increased because of the inaccessibility of the moving parts within the confines of a closed vessel.

Additionally, some difficulties have been encountered in connection with the aforesaid cloth tubes of conventional jet machines. Since a cloth tube is intended to transport the cloth and the liquid issuing from the jet nozzle to a position adjacent the inlet end of the cloth storage compartment, the cloth tube must provide a confined path of movement so that the liquid will have sufficient velocity and force to carry the cloth along with it as it moves through the cloth tube and delivering the cloth to the cloth storage chamber. However, this confined path of movement tends to cause the cloth to bunch up or contract as it flows through the cloth tube, and, as a result, the cloth may not open or expand to the desired extent when it leaves the outlet of the cloth tube for open accumulation in the storage compartment. Additionally, the velocity and force of the liquid, as it leaves the cloth tube with the cloth being carried thereby, may have an adverse effect on the cloth and the uniformity with which it is piled in the cloth storage compartment. Thus, the liquid exiting from the end of the cloth impinges upon the cloth being carried with it as well as upon the cloth which has already accumulated at the inlet end of the storage compartment, and the high velocity of the liquid impinging upon the cloth can result in undesirable surface defects in the cloth. Also, this high velocity liquid will, in some instances, strike the cloth in the storage compartment with sufficient force to bury or fold under the portions of the cloth material, thereby tending to create undesirable tangles in the cloth material as it is transported through the storage compartment.

By contrast, the present invention provides a unique arrangement for uniformly piling or plaiting the cloth as it leaves the cloth tube while avoiding the above-described drawbacks associated with known mechanical plaiting apparatus, and provides a unique cloth tube which assists in opening the cloth as it leaves the confines of the cloth tube while also significantly reducing the velocity of the accompanying liquid and the impinging force of said liquid on the cloth.

SUMMARY OF THE INVENTION

In accordance with the present invention, apparatus for wet processing textile material in rope form is provided with a fixed cloth tube disposed above the bath of processing liquid for delivering the cloth to the bath, preferably to a storage compartment situated in the bath, and a pair of cloth guiding jets are provided at the exit end of the cloth tube for directing opposed streams of liquid into the cloth tube and against the cloth rope in angular relation to the path of movement thereof, and a control arrangement is included for selectively energizing the pair of cloth guiding jets at predetermined time intervals to impose a predetermined path of movement on the rope as it leaves the end of the cloth tube, preferably a generally sinuous path of movement, whereby the cloth laid into the storage compartment in a consistent and uniform manner which promotes an even distribution and uniform piling of the cloth in the cloth storage chamber.

Preferably, the cloth guiding jets are controlled by valves which are disposed outside of the vessel containing the bath so that the only moving parts of the cloth guiding apparatus are readily accessible for maintenance or repair. These valves may be solenoid-operated, and an electrical control system is provided to alternately open and close the valves, such control system including a timer device which selectively varies the time intervals during which each valve is open and thereby varies the form of the generally sinuous path of cloth movement as it leaves the cloth tube.

In accordance with a further feature of the present invention, the cloth tube has a special form which promotes opening of the cloth as it leaves the cloth tube and which reduces the velocity of the fluid as it leaves the cloth tube. This cloth tube includes a first position which extends from the jet nozzle and which has a first predetermined cross-sectional area, and a second end portion from which the endless rope is delivered, this second end portion having a second predetermined cross-sectional area that is substantially greater than the cross-sectional area of the first end portion whereby the aforesaid cloth opening and reduced fluid velocity advantages are obtained. Preferably, the first end portion is cylindrical in shape and the second end portion is rectangular in shape, and an intermediate cloth tube portion is provided between the first and second end portions to provide a smooth flow transition therebetween.

BRIEF DESCRIPTION OF THE DRAWINGS

FIG. 2 is a side view of one end of the cloth tube of the present invention;

FIG. 3 is a diagrammatic view of the exit end of the cloth tube and the cloth directing fluid jets of the present invention; and FIG. 4 is an electrical diagram illustrating the control system for the cloth directing jets of the present invention.

DESCRIPTION OF THE PREFERRED EMBODIMENT

Figure 1:
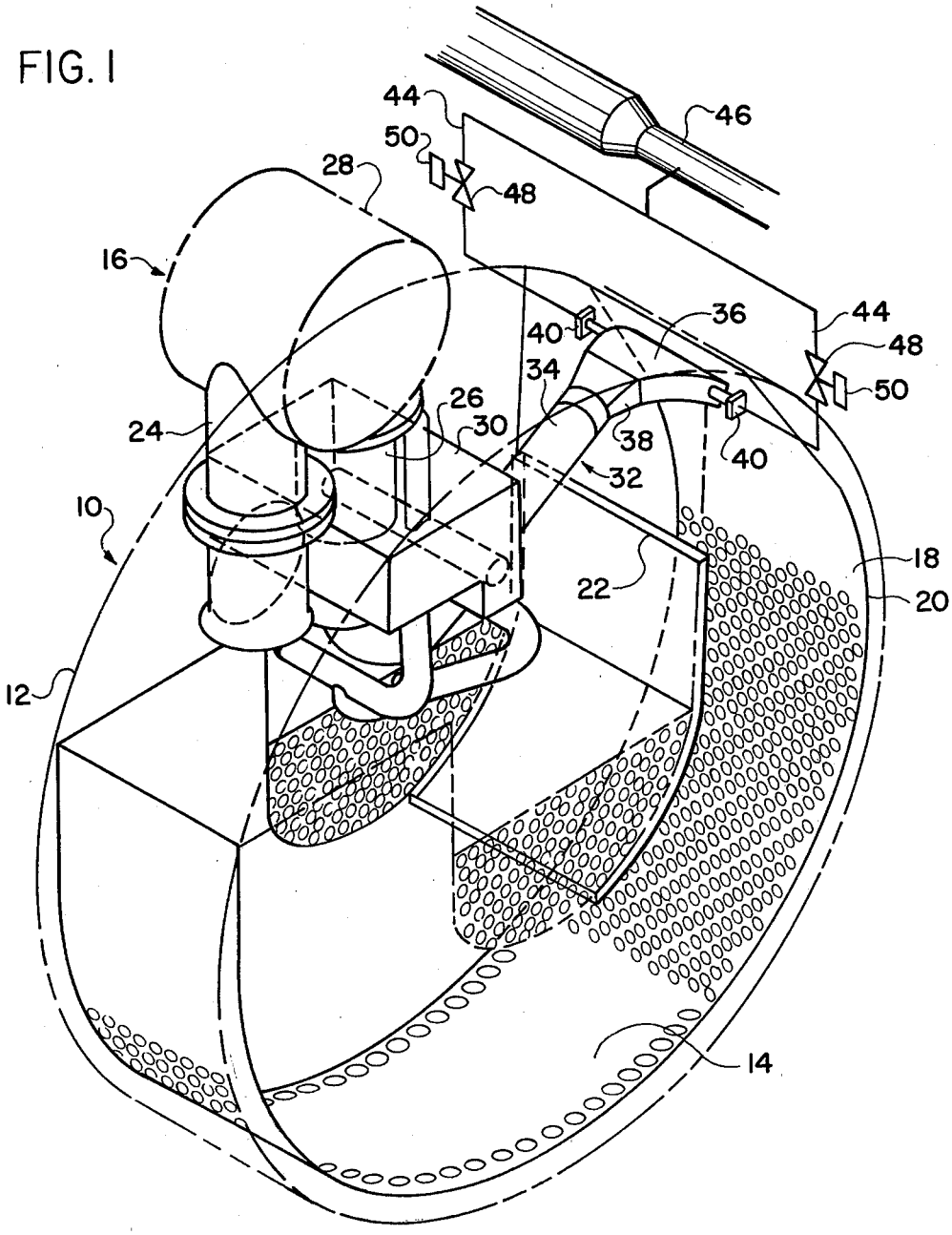
FIG. 1 is a diagrammatic perspective view of apparatus for wet processing textile material embodying the features of the present invention.

Looking now in greater detail at the accompanying drawings, FIG. 1 illustrates diagrammatically typical jet dyeing apparatus 10 in which the novel features of the present invention are incorporated, but it is to be expressly understood that the present machine may also be used in a wide variety of equipment for wet processing textile material in endless rope form. The jet dyeing apparatus 10, except for the novel cloth tube and cloth directing jets to be described presently, is essentially the same as the jet dyeing apparatus described in detail in copending U.S. patent application, Ser. No. 169,145, filed July 15, 1980, U.S. Pat. No. 4,318,286, such description being incorporated herein by reference.

Basically, the jet dyeing apparatus 10 comprises a pressure vessel 12 which provides therein a cloth treating chamber 14 for containing a treating bath of processing liquid, and an external superstructure 16 fitted on the vessel 12 for recirculation therethrough of textile material in endless rope form that is loaded into the vessel through conventional loading ports (not shown). The vessel 10 is provided with a cloth storage compartment 18 formed by the end walls of the vessel, the partially perforate outer wall 20, and the imperforate inner wall 22, this cloth storage compartment 18 extending through the treating bath contained in the vessel 10 for transiently storing in such treating bath a plaited accumulation of a major portion of the cloth being processed. The external superstructure 16 includes a cloth intake leg 24 disposed above the outlet end of the cloth storage compartment 18, and a cloth discharge leg 26 extending downwardly from a lifter reel (not shown) in the reel housing 28. A combined fluid jet and gravitational fluid overflow assembly 30 is disposed beneath the exit end of the cloth discharge leg 26 for receiving and discharging cycled portions of the processing liquid from the treating bath, this combined assembly 30 acting to move the endless rope of cloth through the vessel 10 as described in greater detail in the aforesaid application.

A fixed cloth tube 32, modified in accordance with the present invention, extends from the exit end of the jet and overflow assembly 30 to a location above the inlet end of the cloth storage chamber 18 to receive cloth discharged from the jet and overflow assembly 30 and deliver such cloth to the cloth storage compartment 18. It will be appreciated that the fluid being discharged with the cloth from the jet and overflow assembly 30 has a relatively high velocity, and this velocity is utilized for the purpose of moving the cloth through the cloth tube 32. Because of the length of the cloth tube, and the generally advantageous upward incline thereof as illustrated in FIG. 1, it is usually necessary to provide the cloth tube with a relatively small cross-sectional area which serves to confine and compress the cloth moving therethrough so that it will be entrained in the high velocity flow of fluid exiting from the jet and overflow assembly 30 and insure proper movement of the cloth through the cloth tube 32. However, this confinement of the cloth in the cloth tube 32 and the high velocity of the fluid flow therein present several disadvantages. First, it is desirable for the cloth to be as open as possible when it is delivered to cloth storage chamber 18 so that all parts of the cloth are exposed to the liquid in the treating bath, but the conventional confinement of the cloth in a cloth tube having a relatively small cross-sectional area tends to result in the cloth leaving the cloth tube in a somewhat compressed state which restricts the ability of the cloth to open as it is delivered to the cloth storage compartment 18. Additionally, such a cloth tube tends to maintain the relatively high velocity of the fluid exiting from the jet and overflow assembly 30, and this high velocity fluid, as it leaves the cloth tube, may cause excessive and undesirable impingement of the fluid against the cloth that can mar the cloth during processing. Moreover, this high velocity of the exiting fluid has a tendency to bury the cloth leaving the cloth tube beneath the surface layers of cloth already collected in the cloth storage chamber 14, thereby increasing the possibility of undersirable tangling of the cloth within the cloth storage chamber.

To alleviate the aforesaid drawbacks of conventional cloth tube constructions, the cloth tube 32 of the present invention is specially formed to promote the opening of the cloth as it leaves the cloth tube 32 while also reducing the velocity of the fluid as it leaves the cloth tube to reduce impingement thereof on the cloth. As best seen in FIGS. 1 and 2, the cloth tube 32 includes a first end portion 34 disposed adjacent the exit of the jet and overflow assembly 30 and extending therefrom in a direction toward the cloth storage compartment 18, this first portion having a bend and a generally upwardly inclined major extent. This first end portion 34 has a relatively small cross-sectional area for purposes described above. As best seen in FIG. 2, the cloth tube 32 also includes a second end portion 36 forming the exit end of the cloth tube 32 above the storage compartment 18 (see FIG. 1), and this second end portion 36 has a cross-sectional area that is substantially greater than that of the first end portion 34. An intermediate portion 38 is interposed between the first and second end portions, if necessary, to provide a smooth flow transition therebetween.

In the preferred embodiment of the present invention, the first end portion 34 is cylindrical in shape, the second end portion 36 is rectangular in shape, and the intermediate portion 38 has a suitable geometric configuration that provides a smooth transition between the dissimilar shapes of the first and second end portions. In a typical cloth tube made in accordance with the preferred embodiment of the present invention, the first end portion 34 is a five-inch diameter cylindrical pipe having a cross-sectional area of about twenty-two square inches, and the second end portion 36 is, at its end face, in the shape of a twelve-inch by four-inch rectangle having a cross-sectional area of forty-eight square inches, which is twice as large as the area of the first end portion. However, it is expressly understood that the shapes and dimensions of the first and second end portions may vary depending on the application of the cloth tube, provided that the cross-sectional area of the second end portion 36 is substantially greater than that of the first end portion 34. For example, the second end portion 36 may be square or oval or round in shape if its cross-sectional area is substantially greater than that of the first end portion.

By virtue of the aforesaid construction of the cloth tube 32, it will be apparent that the substantially enlarged end portion 36 will permit a decompression or opening of the cloth as it leaves the cloth tube 32 and is delivered to the cloth storage compartment 18, thereby alleviating the aforesaid problems encountered in conventional cloth tubes with respect to the cloth not being as open as possible while it is transiently moved through the treating bath. Additionally, the enlarged end portion 36 acts to reduce the velocity of the liquid exiting therefrom so as to reduce the tendency of this fluid to unduly impinge on the cloth or to bury cloth beneath the top layers of accumulated cloth in the cloth storage compartment 18.

When the cloth leaves the cloth tube 32 with the fluid in which it is entrained, it is directed toward the inlet end of the cloth storage compartment 18 when it lies on the surface of cloth already accumulated there, and it is important for this cloth to be laid or piled in the storage compartment in an orderly fashion which not only prevents tangling of the cloth but also fills the storage compartment evenly to the maximum extent possible. An uneven distribution of the accumulated cloth in the cloth chamber has a number of disadvantages. First, an uneven distribution of the cloth, which forms voids and concentrated areas of cloth, will result in corresponding uneven weight loads being imposed on the cloth across the area of the cloth storage compartment, and this will result in concentrated high weight loads in some areas which can result in the formation of excessive and undesirable crush marks in a wide variety of fabrics, particularly textured woven fabrics made from modified cross-section yarns. Also, an uneven distribution of the cloth will result in an incomplete filling of the cloth storage compartment 18 whereby the available capacity of the cloth storage chamber 18 and the apparatus 10, in general, is not effectively utilized.

In conventional fixed cloth tube constructions, distribution of the cloth within the cloth storage chamber is generally uncontrolled and haphazard because the cloth is simply dumped on the accumulated cloth in the cloth storage chamber at approximately the center thereof where it tends to build up to a peak or pyramid until gravity causes the peak or pyramid of cloth to topple over in a continuous cycle. This disorderly distribution of the cloth may assume a generally plaited configuration of the cloth within the cloth storage compartment, but the overall distribution of the cloth is somewhat irregular and uneven, which inherently results in the aforesaid disadvantage. As discussed above, these drawbacks have been alleviated to some extent by mechanical distribution devices provided at the exit end of the cloth tube, but these mechanical devices have resulted in disadvantages of their own.

The present invention provides a unique manner of overcoming the drawbacks of mechanical cloth guiding devices while still obtaining an orderly and even distribution of cloth in the cloth storage chamber 18. As best seen in FIGS. 1 and 3, a pair of cloth guiding fluid jets 40 are located adjacent the exit end of the cloth tube 32, and these fluid jets are arranged oppositely with respect to one another for directing opposed streams of fluid into the cloth tube 32 in angular relation to the direction of movement of the cloth rope therethrough. In the preferred form of the cloth tube 32 which has a rectangular cross-section and which is illustrated in FIG. 3, the two fluid jets 40 are arranged in the opposed smaller side walls of the cloth tube 32, and the fluid from these fluid jets flows into the cloth tube 32 through openings 42 (see FIG. 2). This fluid is delivered to the jets 40 by supply lines 44 which extend from a header pipe 46 through which liquid from the treatment bath is recirculated in any convenient manner. The supply lines 44 pass through the side walls of the pressure vessel 12 as illustrated diagrammatically in FIG. 1, and, exteriorly of the pressure vessel 12, each supply line 44 has disposed therein a valve 48 operated by a solenoid 50 between open and closed positions. For reasons to be explained presently, the valves 48 are alternately opened and closed, and the electrical control system for alternately operating the valves 48 is illustrated in FIG. 4. This control system includes an on-off switch 52 in line with a conventional interval timer relay 54, such as a Model No. CRB 48-70180 timer relay manufactured by Potter & Brumfield Company. This timer relay 54 acts to alternately open and close two contacts, represented by reference numerals 54' and 54'' in FIG. 4, at predetermined time intervals which can be adjusted by setting the timer relay 54 at any desired time interval.

As seen in FIG. 3, the fluid jets 40 are preferably arranged to direct a stream of liquid into the cloth tube along lines which are generally perpendicular to the normal direction of cloth movement therethrough, such normal direction corresponding to the centerline of the cloth tube 32. When the fluid jet 40 shown at the left in FIG. 3 is supplied with fluid by the opening of its valve 48, the valve 48 for the right hand fluid jet 40 will automatically be closed so that a stream of pressurized fluid, indicated by lines 56, will be directed against the cloth C just prior to its leaving the cloth tube 32 and cause the cloth C to be guided in a direction toward the right side wall of the cloth storage compartment 18 as shown by the full lines in FIG. 3, and the cloth C will likewise be directed toward the left side wall of the cloth storage compartment 18 when the right-hand fluid jet 40 is operable as shown in dotted lines in FIG. 3. It will be apparent, then, that since the two fluid jets 40 are alternately operated at timed intervals by the control circuit of FIG. 4, the moving rope of the cloth C can be constantly and evenly shifted back and forth to impose a generally sinuous path of movement on the cloth as it leaves the cloth tube 32 so that the cloth is laid into the cloth storage compartment 18 in an orderly fashion that results in the cloth forming a plaited accumulation that is substantially equally distributed in a uniform manner across the entire volume of the cloth storage compartment 18, whereby the aforesaid difficulties resulting from uneven weight distribution and incomplete utilization of cloth storage capacity are largely eliminated. Moreover, since the timer relay 54 can be selectively set to provide any desired time interval between the alternate opening of the valves 48, it is possible to vary the form of the path of movement of the cloth C as it leaves the cloth tube 32 to obtain the most desirable plaiting action for a given fabric being transported through the apparatus at a given operating speed. This time interval range may vary considerably for different fabrics traveling at different speeds, such as from short time intervals of 1.8 seconds to long intervals of 180 seconds.

It is to be noted, also, that the enlarged second end portion 36 of the cloth tube 32 serves not only to permit opening cloth passing therethrough and to reduce the velocity of the cloth carrying fluid as described above, but also to provide ample room for the back-and-forth movement of the cloth under the influence of the alternating fluid jets 40. Moreover, a further significant advantage is obtained from the present invention by virtue of the fact that the valves 48, solenoids 50 and the control circuit which constitute all of the moving parts associated with the fluid jets 40, are all located exteriorly of the pressure vessel 12 so that any maintenance or repair of these components can be quickly and easily effectuated without requiring any entry into the pressure vessel 12.

The present invention has been described in detail above for purposes of illustration only and is not intended to be limited by this description or otherwise to exclude any variation or equivalent arrangement that would be apparent from, or reasonably suggested by the foregoing disclosure to the skill of the art.

I claim:

1. In apparatus for wet processing textile material in endless rope form including a vessel for containing a treating bath of processing liquid and liquid jet means for moving said endless rope through said bath, the improvement comprising a specially formed fixed cloth tube for receiving said endless rope as it leaves said liquid jet means and for delivering said endless rope to said bath, said cloth tube having a first end portion that is cylindrical in shape and that is disposed adjacent the exit of said liquid jet means and extends therefrom with a first predetermined cross-sectional area, a second end portion from which said endless rope is delivered to said bath, said second end portion being rectangular in shape and having a second predetermined cross-sectional area that is substantially greater than said first predetermined cross-sectional area whereby the endless rope will tend to be opened as it leaves said second end portion and whereby the velocity of the liquid flowing from said second end portion will be less than the corresponding velocity in said first end portion.

2. In apparatus for wet processing textile material, the improvement defined in claim 1 and further characterized in that said cloth tube includes an intermediate portion disposed between said first and second end portions and formed to provide a smooth flow transition therebetween.

3. In apparatus for wet processing textile material in endless rope form including a vessel for containing a treating bath of processing liquid, means for moving said endless rope through said bath, and a fixed cloth tube disposed in said vessel above the level of said bath for receiving said endless rope and for delivering said endless rope to said bath, the improvement comprising said cloth tube having an exit end portion formed with a rectangular shape, means for positively guiding the path of movement of said endless rope as it leaves the exit end of said fixing cloth tube, said guiding means including a pair of cloth guiding fluid jets located in opposite side walls of said exit end portion of said cloth tube for directing opposed streams of fluid into said cloth tube in angular relation to the direction of the movement of said rope therethrough, and control means for selectively energizing said pair of cloth guiding jets at predetermined time intervals to thereby impose a predetermined path of movement on said rope as it leaves said exit end of said cloth tube.

4. In apparatus for wet processing textile material, the improvement defined in claim 3 and further characterized in that said streams of fluid from said cloth directing jets flow along lines which are generally perpendicular to the direction of movement of said rope as it leaves said cloth tube.

5. In apparatus for wet processing textile material, the improvement defined in claim 3 and further characterized in that said control means includes a solenoid-operated valve located in the fluid supply line to each of said cloth directing jets and operable between an open and a closed position, and includes electrical circuit means for alternatively opening one of said valves while closing the other of said valves.

6. In apparatus for wet processing textile material, the improvement defined in claim 3 and further characterized in that liquid supply means are provided for recirculating said processing liquid from said bath and through said cloth directing jets as said streams of fluid.

7. In apparatus for wet processing textile material, the improvement defined in claim 3 and further characterized in the said control means for said cloth directing jets is located outside of said vessel so as to be readily accessible for maintenance and repair.

8. In apparatus for wet processing textile material, the improvement defined in claim 3 and further characterized in that said exit end of said cloth tube is located above the inlet end of a rope storage compartment extending into said bath.

9. In apparatus for wet processing textile material, the improvement defined in claim 3 and further characterized in that said control means includes means for selectively adjusting the length of said predetermined time intervals to thereby vary the form of said path of movement of said rope as it leaves said exit end of said cloth tube.

10. In apparatus for wet processing textile material, the improvement defined in claim 4 and further characterized in that said means for moving said rope through said bath is a liquid jet, and in that said cloth tube includes a first end portion disposed adjacent the exit of said liquid jet and formed with a first predetermined cross-sectional area, in that said exit end portion of said cloth tube is formed with a second predetermined cross-sectional area substantially greater than said first cross-sectional area whereby the endless rope will tend to be opened as it leaves said exit end portion and whereby the velocity of the liquid flowing from said exit end portion will be less than the corresponding velocity in said first end portion, and in that said cloth tube includes an intermediate portion disposed between said first and exit end portion and formed to provide a smooth flow transition between said first and exit end portions.

11. In apparatus for wet processing textile material, the improvement defined in claim 10 and further characterized in that said first end portion is cylindrical in shape, and in that said exit end portion is rectangular in shape.

12. A method of wet processing textile material in endless rope form through a bath of processing liquid, said method comprising the steps of:

(a) providing a bath of said processing liquid;

(b) forming a jet of said processing liquid above said bath for circulating said endless rope through said bath;

(c) directing the path of movement of said endless rope through a confined path extending from said circulating jet to an exit location at which said confined path is rectangular in cross-section and at which said rope is guided into said bath;

(d) providing two cloth directing jets of fluid adjacent said exit location and disposed on opposite sides of said rectangularly shaped confined path; and (e) selectively supplying fluid to said opposed cloth directing jets at predetermined time intervals to thereby impose a predetermined path of movement on said rope as it leaves said confined path and is guided into said bath.

13. A method of wet processing textile material as defined in claim 12 and further characterized in that a portion of said processing liquid in said bath is recirculated to form said two cloth directing jets.

14. A method of wet processing textile material as defined in claim 12 and further characterized in that said confined path of movement increases substantially in cross-sectional area as it extends from said circulating jet to said exit location.

15. A method of wet processing textile material as defined in claim 12 and further characterized by the step of selectively varying the duration of said predetermined time intervals to vary the form of said path of movement of said rope as it leaves said confined path.

* * * * *

UNITED STATES PATENT OFFICE

CERTIFICATE OF CORRECTION

Patent No. 4,360,937 Dated Nov. 30, 1982

Inventor(s) Howard G. Putnam

It is certified that error appears in the above-identified patent and that said Letters Patent are hereby corrected as shown below:

Column 2, line 68, after "cloth" insert --is--.

Column 3, line 19, delete "position" and insert therefor --end portion--.

Column 8, line 21, delete "fixing" and insert therefor --fixed--.

Column 8, line 52, delete "the" and insert therefor --that--.

Signed and Sealed this

*Sixth* Day of *August 1985*

[SEAL]

*Attest:*

DONALD J. QUIGG

*Attesting Officer* *Acting Commissioner of Patents and Trademarks*